United States Patent [19]

Nomura

[11] 4,228,645

[45] Oct. 21, 1980

[54] ELECTRONIC TIMEPIECE EQUIPPED WITH ALARM SYSTEM

[75] Inventor: Yasushi Nomura, Tokorozawa, Japan

[73] Assignee: Citizen Watch Company Limited, Tokyo, Japan

[21] Appl. No.: 903,475

[22] Filed: May 8, 1978

[30] Foreign Application Priority Data

May 10, 1977 [JP] Japan ..... 52/53462
Nov. 4, 1977 [JP] Japan ..... 52/131474
Jan. 11, 1978 [JP] Japan ..... 53/1752

[51] Int. Cl.[3] ..... G04C 21/28; G04B 23/12

[52] U.S. Cl. ..... 368/75; 368/245; 368/250; 368/263

[58] Field of Search ..... 58/19 R, 21.11–21.155, 58/38 R, 33, 57.5, 152 B; 325/396; 340/384 E

[56] References Cited

U.S. PATENT DOCUMENTS

| | | | |
|---|---|---|---|
| 3,822,547 | 7/1974 | Fujita | 58/152 B |
| 3,825,836 | 7/1974 | Pyles | 325/396 |
| 3,949,303 | 4/1976 | Mishimura | 325/396 |
| 4,104,862 | 8/1978 | Yamazaki et al. | 58/38 R |
| 4,121,414 | 10/1978 | Yamazaki | 58/21.11 |
| 4,142,361 | 3/1979 | Kimura | 58/50 R |
| 4,147,021 | 4/1979 | Kondo | 58/16 D |

*Primary Examiner*—Vit W. Miska

[57] ABSTRACT

An electronic timepiece equipped with an alarm system in which a single external control member is used as both a snooze switch and an alarm stopping signal. The timepiece has a switching circuit means for generating a snooze signal when the external control member is actuated in a predetermined actuation mode and generating an alarm stopping signal when the external control member is actuated in another predetermined actuation mode. The timepiece includes a snooze control circuit responsive to the snooze signal to temporarily stop an alarm generated by an alarm device, and means for interrupting an alarm enabling signal from being applied to the alarm device to stop the alarm.

11 Claims, 10 Drawing Figures

| Fig. 3A | Fig. 3B |
|---|---|

ELECTRONIC TIMEPIECE EQUIPPED WITH ALARM SYSTEM

This invention relates to an electronic timepiece equipped with an alarm mechanism and having a snooze switch.

In the past, two basic systems for electronic timepieces equipped with an alarm mechanism and having a snooze switch have been proposed. In one system, the timepiece was provided with two switches, namely the snooze switch and an alarm stopping switch. According to the other system, one switch was provided for both purposes, but this structure also required a change-over switch which had to be operated in order to allow the other switch to function in two ways. Thus, both systems required two switches.

Even if a structure in which a single switch serves as both a snooze switch and alarm stopping switch could be devised, a problem would be encountered wherein the alarm would fail to operate if the snooze switch were accidentally switched prior to the arrival of the alarm time. This would be the case unless the timepiece were designed such that the snooze switch is to be operated only when the alarm is sounding. In the case of the alarm stopping switch, on the other hand, there are instances where it is desired to turn off the alarm in advance regardless of whether or not the alarm is sounding. This contradiction was the source of the difficulties encountered in the single-switch system.

It is, therefore, an object of the present invention to provide an electronic timepiece equipped with an alarm system in which the single external control member serves as a snooze switch when the external control member is actuated in a first predetermined actuation mode and serves as an alarm stopping switch when the external control member is actuated in another predetermined actuation mode.

It is another object of the present invention to provide an electronic timepiece equipped with an alarm system in which a single switch member serves as a snooze switch when the switch member is actuated in a predetermined actuation mode, serves as an alarm stopping switch when the switch member is actuated in another predetermined actuation mode, and serves as an alarm-set releasing switch when the switch member is actuated in another predetermined actuation mode.

It is another object of the present invention to provide an electronic timepiece equipped with an alarm system which is symple in circuit arrangement and highly reliable in operation.

These and other objects, features and advantages of the present invention will become apparent from the following description when taken in conjunction with the accompanying drawings, in which.

Figure 1:
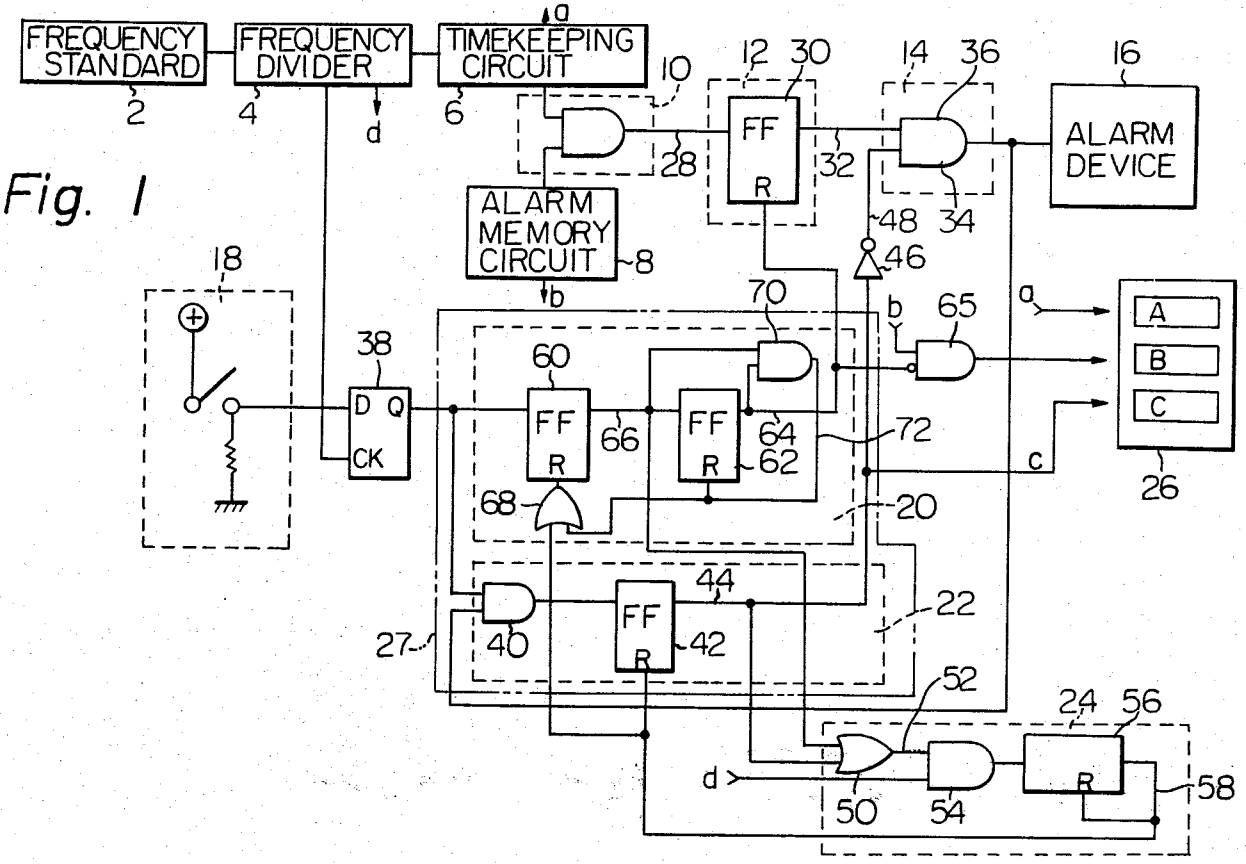
FIG. 1 is a block wiring diagram of a preferred embodiment of an electronic timepiece according to the present invention.

Referring now to FIG. 1, there is shown a block wiring diagram of a preferred embodiment of an electronic timepiece according to the present invention in which a single switch serves as a snooze switch when the single switch is actuated once and serves as an alarm stop switch when the single switch is actuated a number of times within a given time period. The electronic timepiece comprises a frequency standard 2 providing a relatively high frequency signal, a frequency divider 4 responsive to the relatively high frequency signal to provide a relatively low frequency signal and a clock pulse, a timekeeping circuit responsive to the relatively low frequency signal to provide a time information signal indicative of current time, an alarm memory circuit 8 adapted to store alarm time, a coincidence detection circuit 10 to detect a coincidence between the alarm time and current time to provide a coincidence signal, a coincidence memory circuit 12 to store the coincidence signal and provide an alarm enabling signal, a snooze control circuit 14 connected to an output of the coincidence memory circuit 12 to control the supply of the alarm enabling signal to an alarm device 16, an external control member 18 serving as a snooze switch when the control member is actuated a single number of time and serving as an alarm stopping switch when the external control member is actuated a plurality of number of times within a given time period, a switching circuit means 27 including an alarm stop switching circuit 20 for temporarily stopping the alarm in an alarm stop mode and a snooze switching circuit 22 to stop the alarm in a snooze mode, a reset circuit 24, and an electro-optical display device 26.

The coincidence memory circuit 12 is shown as comprising a flip-flop 30 having its reset terminal R connected to and controlled by the alarm stop switching circuit 20. The snooze switching circuit 22 comprises a control gate 40 which is opened by an output signal from the snooze control circuit 14, i.e., only when the alarm is sounding, and a flip-flop 42 for generating a snooze switching signal in response to the switching signal passed through the control gate 40. An output of flip-flop 42 is connected through an inverter 46 to one input of the snooze control circuit 14, thereby inhibiting a snooze control gate 34 by which the alarm device 16 is de-energized to temporarily stop the alarm in a snooze mode.

The alarm stop switching circuit 20 comprises first and second flip-flops 60, 62 adapted to generate an alarm stop control signal on line 64 when switch 18 is actuated a predetermined number of times within a given time period. In the illustrated embodiment, the alarm stop switching signal is shown as applied through line 64 to the reset terminal of the flip-flop 30 of the coincidence memory circuit 12, thereby stopping the alarm by resetting the flip-flop 30. Outputs of flip-flops 60, 62 are connected to inputs of AND gate 70, whose output is connected to a reset terminal of the flip-flop 62 and connected to a reset terminal of the flip-flop 60 through an OR gate 68. Thus, the flip-flops 60, 62 are reset in response to the output of the AND gate 70.

The reset circuit 24 comprises an OR gate 50 having one input coupled to the output of the flip-flop 60 of the alarm stop switching circuit 20 and another input connected to the output of the flip-flop 42 of the snooze switching circuit 22, an AND gate 54 having one input coupled to an output of the OR gate 50 and another input coupled to the frequency divider 4 to receive clock pulses d therefrom, and a counter 56 having its input coupled to an output of the AND gate 54 to provide an output signal when a predetermined time has elapsed after the first actuation of the switch 18, i.e., after receiving the output signal from flip-flops 42 or 60. The output of the timer 56 is coupled to a reset terminal of the flip-flop 42 and to the reset terminal of the flip-flop 60 through the OR gate 68.

When the current time of timekeeping circuit 6 coincides with the alarm time in alarm memory circuit 8, the logic level of output line 28 of coincidence detection circuit 10 changes from low to high level, and that of output line 32, from flip-flop 30 of coincidence memory circuit 12, changes from low to high level and remains at that level. As snooze control circuit 14 is normally open, line 36 attains a high level, and alarm device 16 generates an alarm. If switch 18 is now actuated a single time, a switching signal is passed by flip-flop 38 and transmitted to switching circuits 20, 22. AND gate 40 of snooze switching circuit 22 opens due to the high level at line 36, and the switching signal causes output line 44 of flip-flop 42 to change to and remain at a high level. When line 44 attains the high level, line 48 attains a low level due to the inverter 46, thereby closing the AND gate 34 of snooze control gate 14 and temporarily turning off the sounding alarm. Meanwhile, the output line 52 of OR gate 50 attains a high level due to the high level at line 44, thereby opening AND gate 54 which transmits clock pulses d from frequency divider 4 to the counter 56 which is adapted such that the output line 58 attains a high level after a predetermined period of time such as 5 minutes. This high level resets both the counter itself and flip-flop 42, so that output line 44 now attains a low level and line 48 a high level. AND gate 34 therefore opens so that the alarm sounds a second time.

Thus, switch 18 operates as a snooze switch as long as it is opened and closed once within the given period of time which has been established in the timer circuit 24.

If switch 18 is actuated two number of times within the predetermined time period, flip-flops 60, 62 of the alarm stop switching circuit 20 are actuated so that output line 64 of flip-flop 62 changes to and is held at a high level, whereby flip-flop 30 of alarm coincidence memory circuit 12 is reset and the alarm permanently stopped. The signal c on line 4 is transmitted to display device 26 where a display element C indicates that the switch 18 serves as a snooze switch. Display device 26 also has a display element B coupled to an output of AND gate 65 having one input coupled to the alarm memory circuit 8 and another inverted input coupled to the output line 64 to indicate the alarm time when the display element B is turned on and indicate that the alarm is reset when the element B is turned off. Display device 26 is also adapted to display time by means of display element A in response to time information signal a obtained from timekeeping circuit 6.

The signal fed to alarm stop switching circuit 20 from switch 18 is transmitted regardless of whether or not the alarm is sounding. When the switching signal indicative of a single actuation of switch 18 is transmitted, line 66 attains a high level as does output line 52 of OR gate 50. Since output line 58 attains a high level 5 minutes later, flip-flop 60 is reset through OR gate 68. In consequence, the output line 66 of flip-flop 60 attains a high level as does output line 44 of flip-flop 42 even when switch 18 is operated as a snooze switch by manipulating it during the sounding of the alarm. Five minutes later, however, flip-flop 42 is reset and the alarm sounds again at the same time that flip-flop 60 is reset. Alarm stop switching circuit 20 is thus restored to its original state so that the alarm is never permanently shut off even if switch 18 is used repeatedly as a snooze switch.

Since the alarm stop switching circuit 20 and snooze switching circuit 22 are separately provided, switching circuit 22 operates only when output line 36 is at a high level, that is, only when the alarm is sounding. Switching circuit 20, on the other hand, operates regardless of whether or not the alarm is sounding. As a result, even if switch 18 is operated as a snooze switch immediately before the issuance of the alarm, the alarm will not fail to sound once the set time has been reached. Furthermore, switch 18 can be used as an alarm stopping switch to permanently shut off the alarm whenever it is not needed.

When switch 18 is opened and closed once with output line 66 at a low level and output line 64 at a high level, output line 66 attains a high level, output line 72 of AND gate 70 attains a high level, and flip-flops 60, 62 are reset, thereby releasing the alarm from the reset state. Although the use of a single switch for both an alarm stopping and snooze function makes it necessary to clarify how the switch is being used, in the present embodiment this is achieved by the provision of the display element C which shows that the switch is being used as the snooze switch.

Figure 2A:
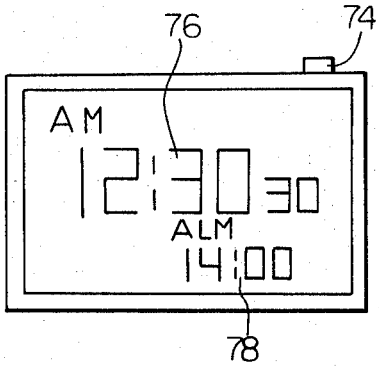
FIGS. 2A to 2C show a modification of a display device shown in FIG. 1.
Figure 2B:
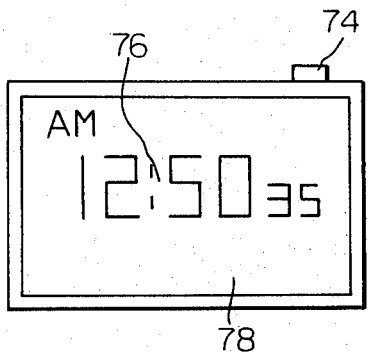

FIGS. 2A and 2B show an external view of a display device of another preferred embodiment of an electronic timepiece equipped with an alarm according to the present invention. In FIG. 2A, a switch 74 serves as both a snooze switch and an alarm stopping switch. A normal time display section 76 indicates that the actual time is 12:30:30 AM, and an alarm display section 78 indicates that the alarm has been set to chime at 2:00 PM.

Figure 2C:
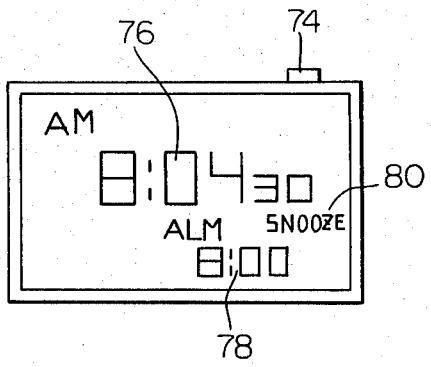

If switch 74 is depressed twice within 5 minutes, the switch acts as an alarm stopping switch and erases the display from alarm display section 78, as shown in FIG. 2B. If switch 74 is depressed once while the alarm is sounding, the switch acts as a snooze switch. This fact is indicated by the excitation of a display section 80 as illustrated in FIG. 2C.

Thus, the use of display means in the present timepiece for the purpose of discriminating the use of the single switch 74 allows the adoption of the single-switch system without any inconvenience and therefore provides important practical effects.

Figures 3, 3A:
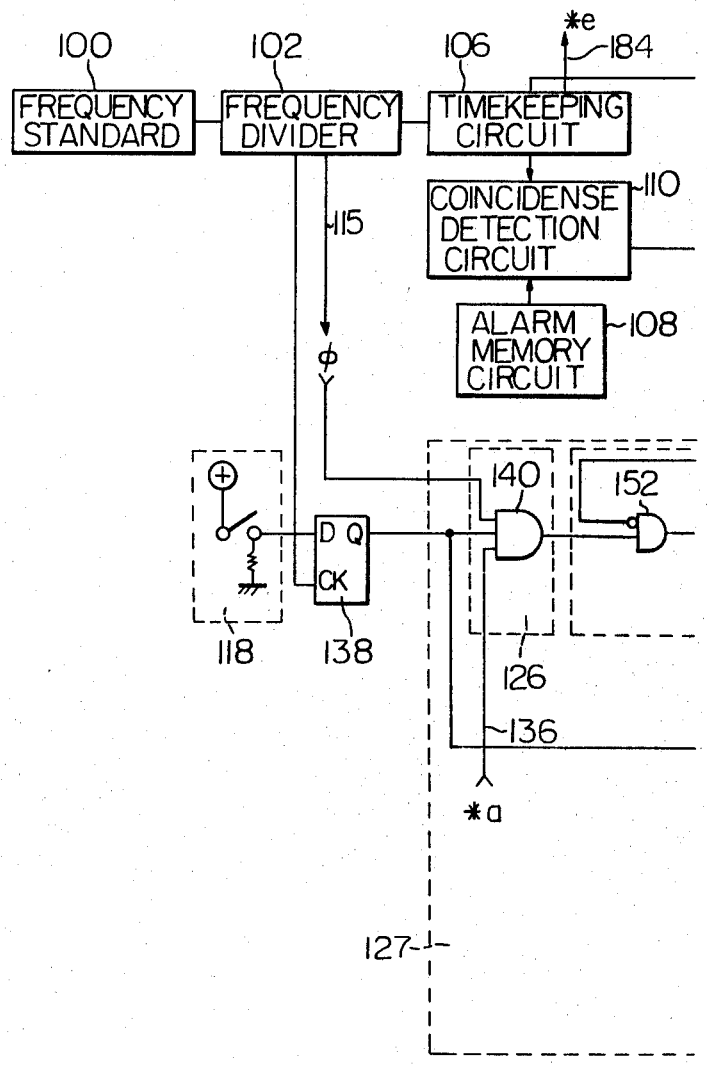
FIGS. 3A and 3B show a block wiring diagram of another preferred embodiment of an electronic timepiece according to the present invention.
Figure 3B:
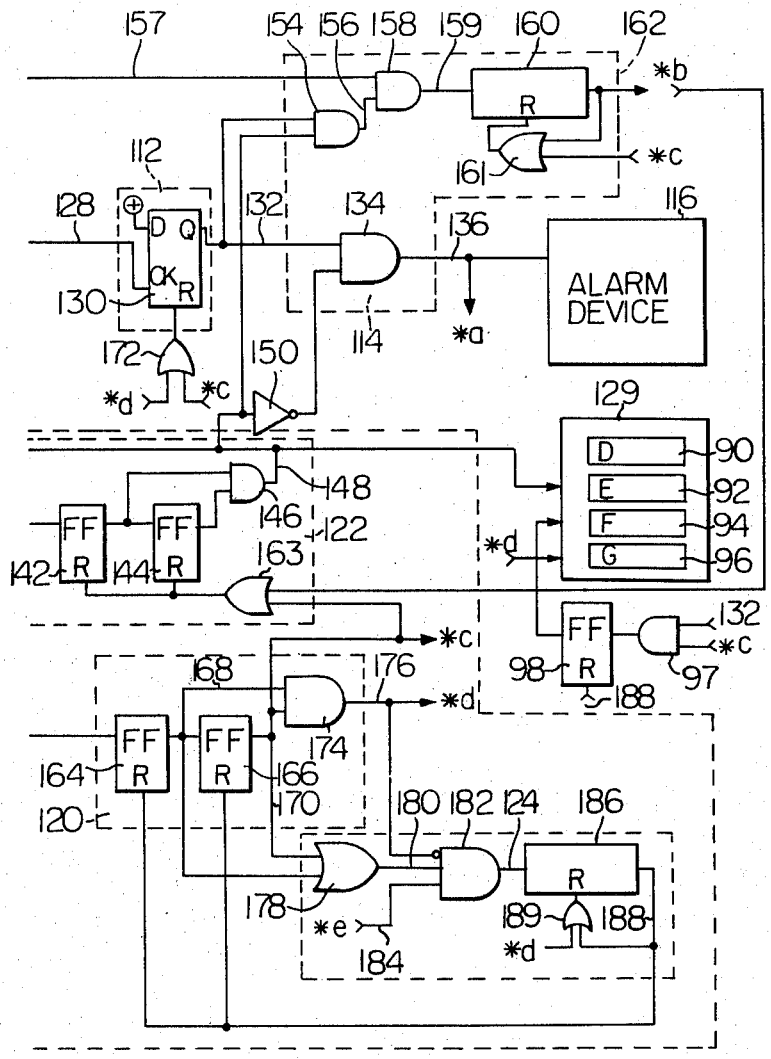

FIG. 3 shows another preferred embodiment of an electronic timepiece according to the present invention. In this preferred embodiment, the timepiece comprises a frequency standard 100 providing a relatively high frequency signal, a frequency divider 102 providing a relatively low frequency signal and clock pulses in response to the relatively high frequency signal, a timekeeping circuit 106 for providing a time information signal indicative of current time in response to the relatively low frequency signal, an alarm memory circuit 108 adapted to store alarm time, a coincidence detection circuit 110 to detect a coincidence between the current time in the timekeeping circuit 106 and the alarm time stored in the alarm memory circuit 108, a coincidence memory circuit 112 to store a coincidence signal delivered from the coincidence detection circuit 110 and provide an alarm enabling signal, a snooze control circuit means 114, an alarm device 116, an external control member 118 serving as an alarm stop switch and a snooze switch, an alarm stop switching circuit 20 for stopping the alarm and which also serves as a second detection circuit adapted to detect the number of times switch 118 is operated, a snooze switching circuit 122 which also serves as a first detection circuit adapted to detect the operation time of switch 118, a timer circuit 124, an inhibiting gate circuit 126, a switch control circuit 127 and an electro-optical display device 129.

The snooze control circuit means 114 comprises AND gates 134, 154 and 158, an OR gate 161 and a time counter 160. The AND gate 134 has one input coupled through an output line 132 to an output of a flip-flop 130 of the coincidence memory circuit 112 and another input coupled through an inverter 150 to the snooze switching circuit 122, and an output coupled through an output line 136 to the display device 129. The AND gate 154 has one input coupled to the output of the flip-flop 130 and another input coupled to the snooze switching circuit 122, and an output coupled to one input of the AND gate 158 whose another input coupled to an intermediate stage of the timekeeping circuit 106. An output of the AND gate 158 is coupled through an output line 159 to an input of the time counter 160. The time counter 160 has its output coupled to the snooze switching circuit 122 and to a reset terminal of the counter 160 through the OR gate 161.

The snooze switching circuit 122 comprises an AND gate 152, flip-flops 142, 144, an AND gate 146, and an OR gate 163. The AND gate 152 has one input coupled to an output of the inhibiting gate 126 and another inverted input coupled to an output of the AND gate 146, to which inverter 150 and display device 129 are also connected. An output of the gate 152 is connected to an input of the flip-flop 142, whose output is connected to an input of flip-flop 144. Outputs of flip-flops 142, 144 are connected inputs of the AND gate 146. The OR gate 163 has one input coupled to output line 162 of the timer circuit 160 and another input coupled to output line 170 of the alarm reset switching circuit 120, and an output coupled to reset terminals of the flip-flops 142, 144.

The alarm stop switching circuit 120 comprises flip-flops 164, 166, and AND gate 174. An input of the flip-flop 164 is coupled to an output of flip-flop 138. The flip-flop 164 has its output coupled to one input of the AND gate 174 and an input of flip-flop 166 whose output is coupled to another input of the AND gate 174, one input of OR gate 161, and the timer circuit 124.

The reset circuit 124 comprises an OR gate 178, an AND gate 182, a time counter 186 and an OR gate 189. The OR gate 178 has one input coupled to the output line 170 and another input coupled to the output of the flip-flop 164, and an output coupled to a first input of the AND gate 182. The AND gate 182 has a second input coupled to receive an output signal *e delivered from the timekeeping circuit 106, and a third input coupled to output line 176. An output of the AND gate 182 is coupled to an input of the time counter 186, whose output is coupled to reset terminals of flip-flops 164, 166 and to a reset terminal of the counter 186 through OR gate 189 through which an output signal *d delivered from the AND gate 174 is also applied to the reset terminal of the time counter 186.

When the current time of the timekeeping circuit 106 coincides with the alarm time stored in the alarm memory circuit 108, the coincidence circuit 110 generates a coincidence signal which is fed through output line 128 to the coincidence memory circuit 112. The logic level of the output line 132 of the coincidence memory circuit 112 goes to a high level. Since, in this case, the AND gate 134 of the snooze control gate means 114 is normally open, the alarm device 116 is energized to generate an alarm. If switch 118 is now depressed a short period of time, a switching signal is passed by flip-flop 138 and transmitted to inhibiting gate circuit 126 and snooze switching circuit 122, and to alarm stop switching circuit 120. As line 136 is at a high logic level, AND gate 140 of inhibiting gate circuit 126 opens as long as switch 118 continues to be depressed. A clock pulse $\phi$ delivered by line 115 from frequency divider 102 is therefore transmitted to snooze switching circuit 122 composed of flip-flops 142, 144 the outputs of which attain a high level. At this time, the output line 148 of AND gate 146 attains a high level which, through the intermediary of inverter 150, closes AND gate 134 and temporarily turns off the sounding alarm. When line 148 attains a high level, gate 152 also closes, so that the states of flip-flops 142, 144 will not change even if switch 118 remains depressed for longer than is necessary.

Meanwhile, since lines 132, 148 are at a high level, output line 156 from AND gate 154 of snooze control circuit 114 attains a high level and AND gate 158 opens, allowing a clock pulse from timekeeping circuit 184 to enter the time counter 160 via lines 157, 159. Line 162 will therefore attain a high level after a predetermined period of time, thereby resetting time counter 160 through OR gate 161 as well as flip-flops 142, 144 of snooze switching circuit 122 through OR gate 163. AND gate 134 will therefore open, raising line 136 to a high level so that the alarm will sound a second time.

Thus, if switch 118 is held depressed for a short period of time until the output line 148 of snooze switching circuit 122 attains a high level due to the clock pulse $\phi$, the switch will operate as a snooze switch.

However, when line 136 is at a low level, that is, when the alarm is not sounding because of the absence of the alarm signal, AND gate 140 of inhibiting gate circuit 126 is closed so that the signal indicative of the depression of switch 118 within a short period of time has no effect upon flip-flops 142, 144 of snooze switching circuit 122. On the other hand, however, the circuitry is designed such that a signal indicative of the number of operations of switch 118 is transmitted as is to alarm resetting circuit 120 so that the alarm can be permanently released from the set state at any time.

When output line 170 from flip-flop 166 of alarm reset switching circuit 120 attains a high level due to opening and closing switch 118 a number of times, which opening and closing operation may include holding the switch depressed for a short period of time, flip-flop 130 of alarm coincidence memory circuit 112 is reset through OR gate 172 and the alarm is permanently stopped. If the switch 118 has already been operated as a snooze switch but it is now desired to use the switch to permanently stop the alarm, the circuitry is designed such that the signal on line 170 resets flip-flops 142, 144 of snooze switching circuit 122 through OR gate 163, and time counter 160 through OR gate 161. Moreover, when output lines 168, 170 of flip-flops 164, 166 both attain a high level due to operation of switch 118, output line 176 of AND gate 174 attains a high level so that flip-flop 130 is reset in this case also through OR gate 172.

If only one of flip-flops 164, 166 attains a high level, this fact is detected by OR gate 178 of reset circuit 124, line 180 attains a high level and gate 182 opens, allowing a signal delivered from timekeeping circuit 106 via line 184 to enter time counter 186. Line 188 will therefore attain a high level after a predetermined period of time, thereby resetting time counter 186 and flip-flops 164, 166 of alarm stopping circuit 120.

If time counter 186 is preset to a time period which is shorter than that of time counter 160, switch 118 will operate as a snooze switch by depressing it one time. If the switch is then to be used again as a snooze switch, and even if output line 168 of flip-flop 164 is at a high level, the flip-flop is in the reset state at the time that the switch is depressed; hence, flip-flop 166 attains a high level even if the switch is successively used a second time as a snooze switch. Switch 118 will thus not operate as an alarm stopping switch in the above situation.

When coincidence memory circuit 112 is reset by the high level signal which appears on output line 170 of flip-flop 166, the reset state is cancelled by a signal from reset circuit 124. The alarm will sound again if coincidence detection circuit 110 issues a coincidence signal after an elapse of 24 hours.

When line 176 attains a high level, reset circuit 124 does not operate because gate 182 is closed. Alarm memory circuit 130 accordingly remains in the reset state; this is the state for permanently releasing the alarm from the set condition, and the state will continue as long as the switch 118 is not operated again.

Turning to electro-optical display device 129, a display element 90 indicates the current time and the time to which the alarm has been set by switching over between the two, a display element 92 indicates that the switch 118 is actuated as the snooze switch, a display element 94 indicates that the switch 118 is actuated as an alarm stopping switch and is turned on by an output of flip-flop 188 responsive to an output of AND gate 97 when the output line 132 and signal *c go to a high level, and a display element 96 indicates that the alarm has been set or released from the set state. Display device 129 therefore allows switch 118 to be operated without error.

It should be understood that the function of the switch 118 may be modified so as not to perform the switch operation that releases the alarm from the set state. It is also possible to reverse the function of the switching circuits from that described above, wherein snooze switching circuit 122 was constructed to detect the period of time switch 118 was depressed, while alarm reset switching circuit was constructed to detect the number of times switch 118 was opened and closed. Moreover, the period of switch depression can be arbitrarily selected, as can the time periods to be established in time counters 160, 186.

In the embodiment of FIG. 3, a single switch 118 is adapted to serve as both a snooze switch and alarm stopping switch, and the circuitry is therefore designed such that the number of switch operations and switch operation time can be detected in an independent manner. The timepiece of FIG. 3 is extremely convenient since a simple change in switch operation either temporarily shuts off the alarm or permanently stops the alarm. A structure is also possible wherein the snooze, alarm stop and alarm set release are differentiated among by changing the states of excitation of a number of segments on a single display member used to indicate the state of switch operation. When the alarm set release function is excluded from the dual function of switch 118, a structure can be modified such that, when a signal indicative of the opening and closing of switch 118 is transmitted to alarm stopping circuit 120, said signal will be transmitted through the inhibiting gate circuit 126 as controlled by the alarm signal.

Figure 4:
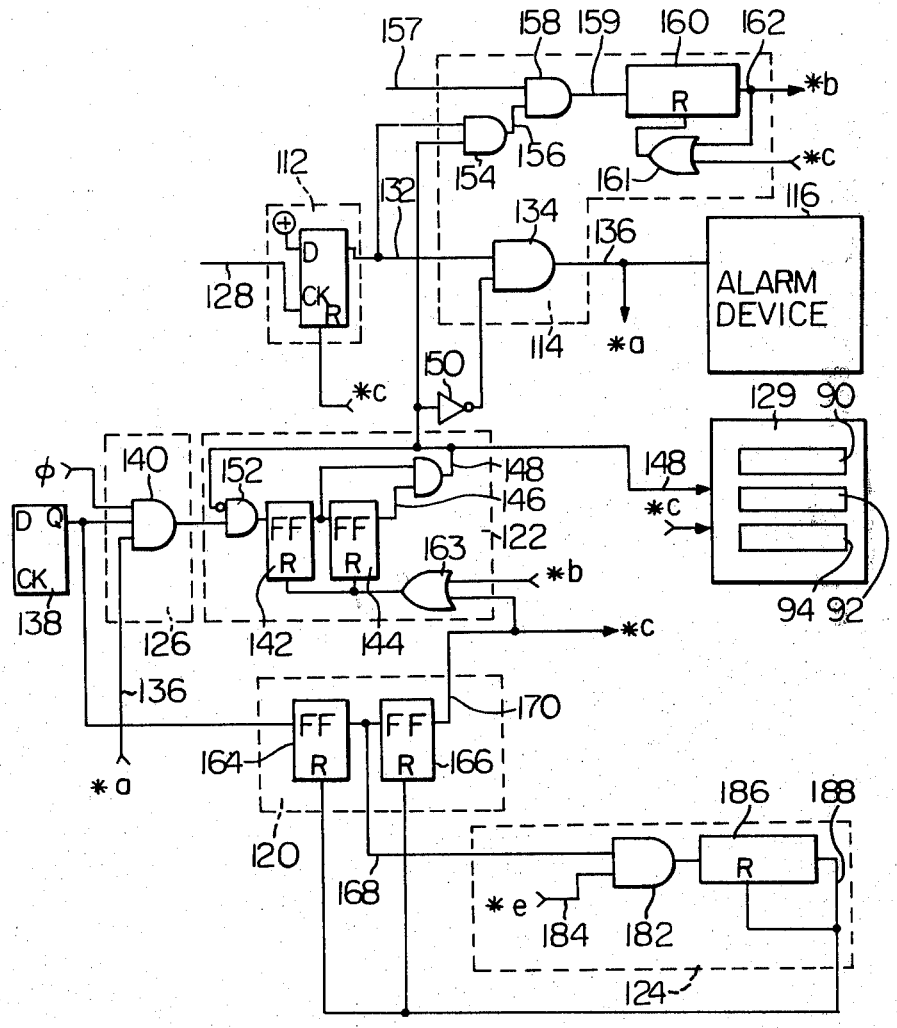
FIG. 4 is a block wiring diagram of a modified form of the timepiece shown in FIG. 3.

When the dual function structure of switch 118 is adapted to allow the switch to operate as a snooze switch and a switch for releasing the alarm from the set state, the circuit of FIG. 3 can be modified such that line 170 is not connected to reset circuit 124, while line 168 is connected directly to AND gate 182, thus permitting the removal of OR gate 178. This also eliminates the necessity for AND gate 174. In other words, when line 170 attains a high logic level, the alarm is permanently stopped and the alarm is simultaneously released from the set state. This modified circuit is illustrated in FIG. 4. Accordingly, display element 94 for indicating that the alarm has been stopped will in this case also indicate that the alarm has been released from the set state.

Figure 5:
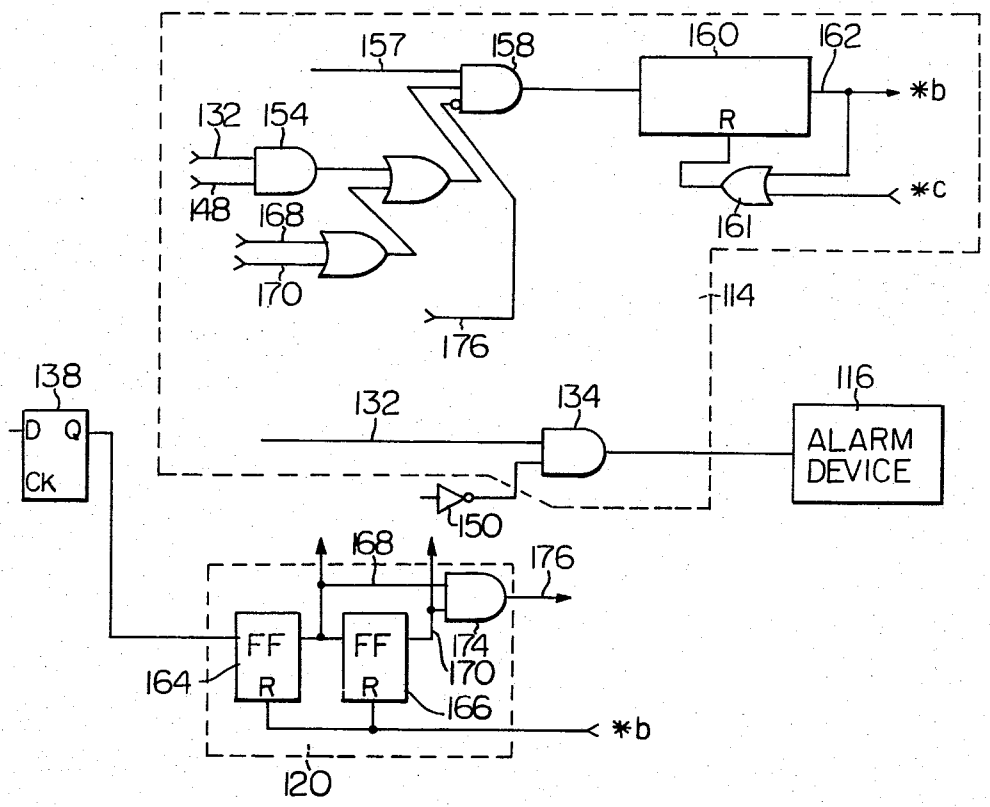
FIG. 5 is a block wiring diagram of another modified form of the timepiece shown in FIG. 3.

In still another alternative, a circuit could be modified in which a timer mechanism incorporating the time counter 160 of snooze control circuit 114 is utilized in place of the reset circuit 124. This modification is shown in FIG. 5, wherein reset circuit 124 has been removed and the output lines from alarm stopping circuit 120 are directly connected to snooze control circuit 114. Flip-flops 142, 144 are reset by the output signal from time counter 160.

Figure 6:
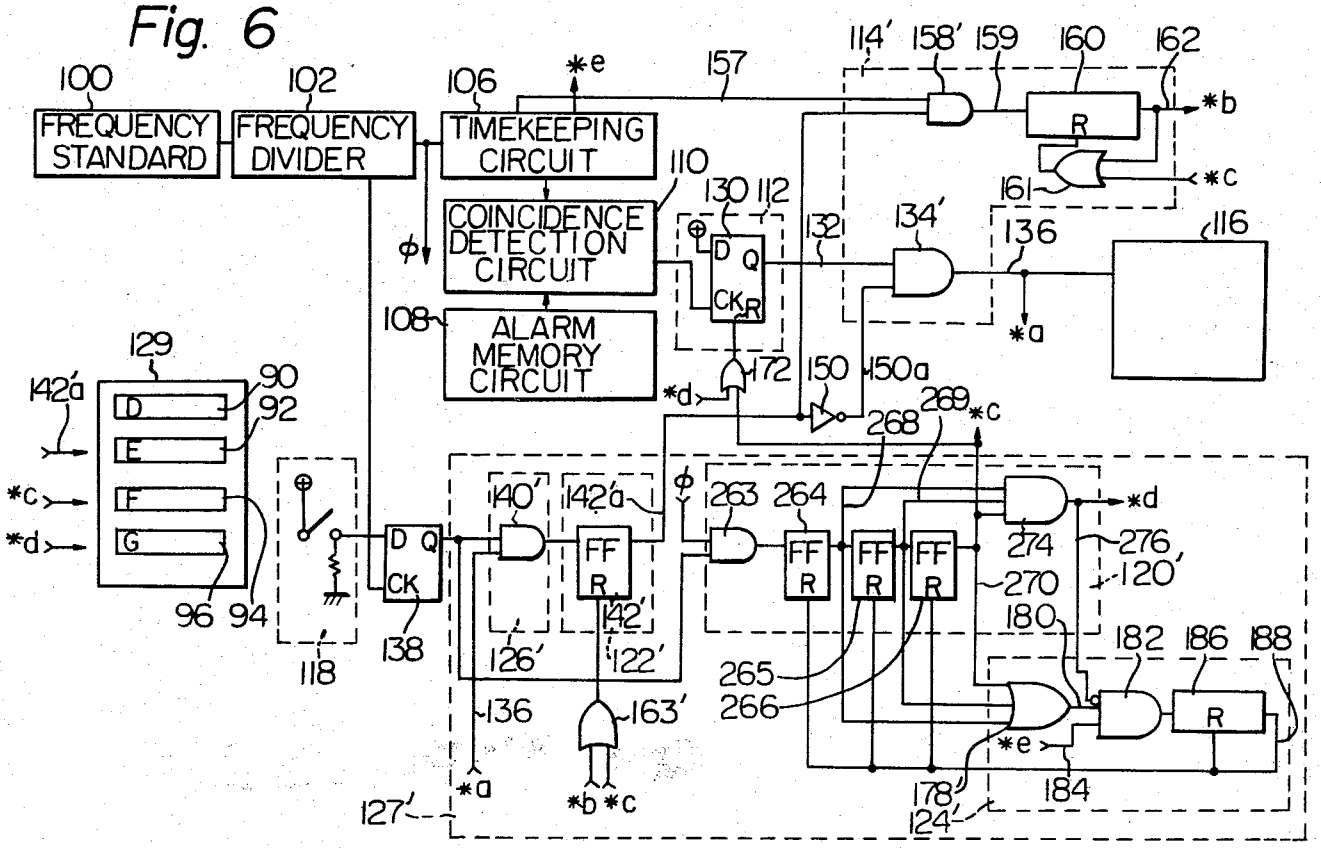
FIG. 6 is a block wiring diagram of another preferred embodiment of an electronic timepiece according to the present invention.

FIG. 6 shows another preferred embodiment of an electronic timepiece according to the present invention, with like or corresponding parts bearing the same reference numerals as those used in FIG. 3. In this illustrated embodiment, the snooze control circuit 114' comprises AND gates 134' and 158', a time counter 160, and an OR gate 161. The AND gate 134' has one input coupled to the output of the coincidence memory circuit 112 and another input coupled through inverter 150 to an output of snooze switching circuit 122'. The AND gate 158' has one input coupled to the timekeeping circuit 106 and another input coupled to the output of the snooze switching circuit 122'. The time counter 160 and OR gate 161 are identical in construction as those shown in FIG. 3.

A switching control circuit 127' comprises an inhibiting gate circuit 126' composed of an AND gate 140' having its one terminal coupled to an output of flip-flop 138 and another input coupled to output line 136, snooze switching circuit 122', alarm stop switching circuit 120', and a reset circuit 124'. The snooze switching circuit 122' comprises a flip-flop 122' having its input coupled to an output of the AND gate 140' and its output coupled to the inverter 150. The flip-flp 142' also has a reset terminal coupled to an output of OR gate 163' responsive to signals *b and*c.

The alarm stop switching circuit 120' comprises AND gates 263 and 274, and flip-flops 264, 265 and 266. The AND gate 263 has its one input coupled to the frequency divider to receive a clock pulse $\phi$ and another input coupled to the output of flip-flop 138 to receive a switching signal therefrom. An output of the AND gate 263 is coupled to an input of flip-flop 264, whose output is coupled to an input of flip-flop 265 having its output coupled to an input of flip-flop 266. Outputs of flip-flops 264, 265 and 266 are connected to inputs of AND gate 274 which produces an output signal *d as an alarm set release signal which is applied through OR gate 172 to the reset terminal of the coincidence memory circuit 112 and to the reset circuit 124'. The flip-flop 266 generates an alarm stop signal *c which is applied through OR gate 161 to the reset terminal of the time counter 160, through OR gate 172 to the reset terminal of the coincidence memory circuit 112, and to the reset circuit 124'.

The reset circuit 124' is identical to that shown in FIG. 3 except that the inputs of the OR gate 178' are coupled to the outputs of the flip-flops 264, 265 and 266 and that the time counter 186 is adapted to be reset only by the output of the time counter 186.

When the alarm time stored in the alarm memory circuit coincides with the current time in the timekeeping circuit 184, the coincidence memory circuit 110 generates a coincidence signal which is applied to and stored in the coincidence memory circuit 112. The coincidence memory circuit generates an output signal as an alarm enabling signal which is applied to AND gates 134 and 154. In this case, the AND gate 154 is inhibited while the AND gate 134 is opened so that the alarm enabling signal is applied through the AND gate 134 to the alarm device 116 by which an alarm is generated. If switch 118 is now depressed a single time, a switching signal is passed by flip-flop 138 and transmitted to inhibiting gate circuit 126' and snooze switching circuit 122' on the one hand and to alarm stop switching circuit 120' on the other. As line 136 is at a high logic level, AND gate 140' of inhibiting gate circuit 126' opens. The switching signal is therefore transmitted to snooze switching circuit 122 having flip-flop 142' the output of which attains and remains at a high level. At this time, the output of inverter 150 attains a low level, thereby closing AND gate 134' and temporarily turning off the sounding alarm.

Meanwhile, when the output of flip-flop 142' attains a high level, AND gate 158' of snooze control circuit 114' opens, allowing a signal from timekeeping circuit 106 to enter time counter 160 via line 157. Counter output line 162 will therefore attain a high level after a predetermined period of time, thereby resetting time counter 160 through OR gate 161 and flip-flop 142' of snooze switching circuit 122' through OR gate 163'. Line **142'*a* will attain a low level and line 150*a* a high level through inverter 150, thereby opening AND gate 134'** so that the alarm will sound a second time.

In other words, when the alarm is sounding, i.e., when inhibiting gate 126' has been opened, switch 118 operates as a snooze switch when it is actuated once. However, when line 136 is at a low level, that is when the alarm is not sounding because of the absence of the alarm enabling signal, AND gate 140' of inhibiting gate circuit 126' is closed so that the switching signal has no effect upon flip-flop 142' of snooze switching circuit 122'. On the other hand, however, the circuitry is designed such that a signal indicative of the operation time of switch 118 is transmitted as is to alarm stopping circuit 120' so that the alarm can be permanently released from the set state at any time.

In order to establish these conditions in alarm stopping circuit 120', it is designed to produce an output signal only when switch 118 is depressed for an extended period of time, thus assuring that merely depressing the switch for a short period during an opening and closing operation will not generate an alarm stop signal or a signal for releasing the alarm from the set state. For example, if switch 118 is depressed for an extended period of 2 or 3 seconds or more, AND gate 263 of alarm stopping circuit 120' will open, allowing a signal $\phi$, such as a 1 Hz signal, to be transmited from frequency divider 102 to flip-flops 264, 265, 266. When output line 270 of flip-flop 266 attains a high level 3 or 4 seconds later, flip-flop 130 of alarm coincidence memory circuit 112 is reset through OR gate 172, thereby permanently stopping the alarm. If the switch 118 has already been operated as a snooze switch but it is now desired to use the switch to permanently stop the alarm, the circuitry is designed such that the signal on line 270 resets flip-flop 142' of snooze switching circuit 122' through OR gate 163', and time counter 160 of snooze control circuit 114' through OR gate 161. Moreover, when switch 118 is continuously held depressed, output lines 268, 269, 270 of flip-flops 264, 265, 266 all attain a high level, so that flip-flop 130 is reset in this case also through OR gate 172.

If only one of flip-flops 264, 265, 266 attains a high level, this fact is detected by OR gate 178' of reset circuit 124', line 180 attains a high level and gate 182 opens, allowing a signal delivered from timekeeping circuit 106 via line 184 to enter time counter 186. Line 188 will therefore attain a high level after a predetermined period of time, thereby resetting time counter 186 and flip-flops 264, 265, 266 of alarm stopping circuit 120'.

If time counter 186 is preset to a time period which is shorter than that of time counter 160, switch 118 will operate as a snooze switch by subjecting it to one actuation. During this operation, flip-flop 264 is reset by reset circuit 124' by the time the alarm is schedualed to sound again, even if output line 268 of flip-flop should attain a high level with AND gate 263 in the open state. Hence, the alarm will not be permanently stopped even if switch 118 is subjected to a successive opening and closing operation as a snooze switch.

When coincidence memory circuit 112 is reset by the high level signal which appears on output line 270 of flip-flops 266, the reset state is cancelled by a signal from reset circuit 124'. The alarm will sound again if coincidence detection circuit 110 issues a coincidence signal after an elapse of 24 hours.

When line 276 attains a high level, reset circuit 124' does not operate because gate 182 is closed. Alarm memory circuit 130 accordingly remains in the reset state; this is the state for permanently releasing the alarm from the set condition, and the state will continue as long as the switch 118 is not operated again. If the switch is operated again by being depressed for one second, the set state will be established.

When the dual function structure of switch 118 is adapted to allow the switch to operate as a snooze switch and a switch for releasing the alarm from the set state, the circuit of FIG. 6 can be modified such that line 270 is not connected to reset circuit 124'; hence, the only inputs to OR gate 178' would be delivered on lines 268, 269. This also eliminates the necessity for AND gate 274. In other words, when line 270 attains a high logic level, the alarm is permanently stopped and the alarm is simultaneously released from the set state. Accordingly, display element 94 for indicating that the alarm has been stopped will in this case indicate that the alarm has been released from the set state.

In still another alternative, a circuit could be modified in which a timer mechanism incorporating the time counter 160 of the snooze control circuit 114' is utilized in place of the reset circuit 124'. In this case, reset circuit 24 is removed from FIG. 6 and the output lines from alarm stopping circuit 120' are directly connected to snooze control circuit 114'. Flip-flop 142' is reset by the output signal from time counter 156.

Figure 7:
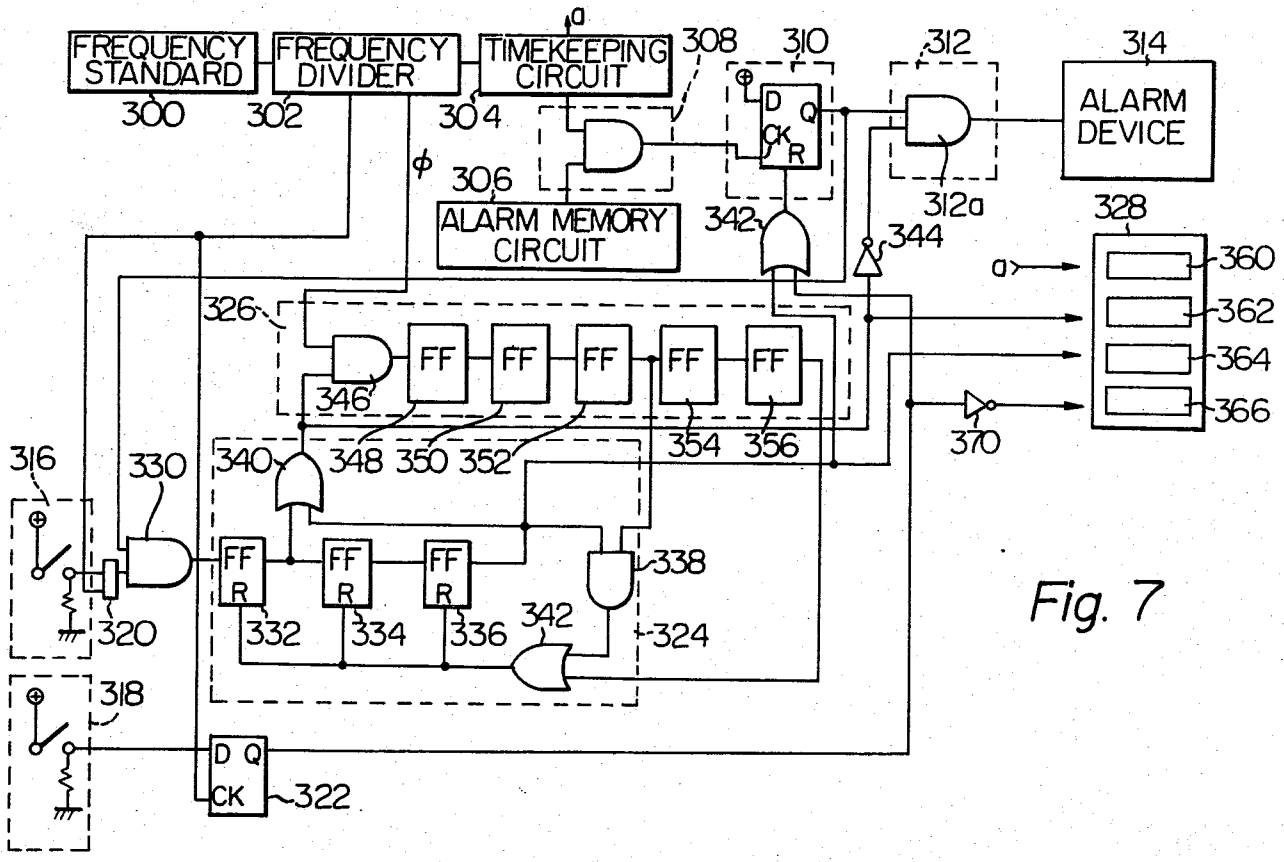
FIG. 7 is a block wiring diagram of a further preferred embodiment of an electronic timepiece according to the present invention.

FIG. 7 shows another preferred embodiment of an electronic timepiece according to the present invention incorporating an alarm system including a first external control member serving as a snooze switch and an alarm stop switch and a second external control member serving as an alarm-set releasing switch. The electronic timepiece comprises a frequency standard 300, a frequency divider 302, a timekeeping circuit 304, an alarm memory circuit 306, a coincidence detection circuit 308, a coincidence memory circuit 310, a snooze circuit 312, an alarm device 314, first and second external control members 316, 318, flip-flops 320, 322 a switch control circuit means 324, a reset circuit 326, and a display device 328.

The flip-flop 320 is identical to the flip-flop 38 shown in FIG. 1 and generates switching signals when the external control member 316 is actuated. The switching signals are applied to one input of an inhibiting gate 330 having its another input coupled to an output of the coincidence memory circuit 310. The inhibiting gate 330 comprises an AND gate which is opened only when the alarm enabling signal is produced by the coincidence memory circuit 310, to pass the switching signals to the switch control circuit means 324.

The switch control circuit means 324 comprises flip-flops 332, 334, 336, an AND gate 338, and OR gates 340, 342. The flip-flop 332 has its input coupled to the output of the inhibiting gate 330 and its output coupled to an input of flip-flop 334, whose output is coupled to an input of flip-flop 336. The flip-flops 332, 334, 336 have reset terminals connected to an output of the OR gate 342 having its one input coupled to an output of the reset circuit 326 and its another input coupled to an output of the AND gate 338. The AND gate 338 has its one input coupled to the reset circuit 326 and another input coupled to the output of the flip-flop 336. The output of the flip-flop 336 is also coupled to one input of the OR gate 340 whose another input is coupled to the output of the flip-flop 332. An output of the OR gate 340 is connected to the reset circuit 326. The output of the flip-flop 336 is also coupled through an OR gate 342 to the reset terminal of the coincidence memory circuit 310. The output of the OR gate 340 is coupled through an inverter 344 to one input of an AND gate **312*a* of the snooze control gate 312**.

The reset circuit 326 comprises an AND gate 346, and a time counter composed of flip-flops 348 to 356. The AND gate 346 has one input coupled to the frequency divider 302 to receive a clock pulse therefrom and another input coupled to the output of the OR gate 340, and an output coupled to the time counter.

The second external control member 318 serves as an alarm-set releasing switch and generates an input signal when actuated. This input signal is applied to the flip-flop 322 which serves as a means for generating an alarm-set releasing signal in response to the input signal delivered from the external control member 318. The alarm-set releasing signal is applied through the OR gate 342 to the reset terminal of the coincidence memory circuit 310 to reset the coincidence memory circuit 310, thereby releasing the circuit 310 from its set state.

When the alarm time stored in the alarm memory circuit 306 coincides with the current time in the timekeeping circuit 304, the coincidence detection circuit 308 generates a coincidence signal which is applied to the coincidence memory circuit 310. The coincidence memory circuit 310 generates an alarm enabling signal which is applied through snooze control circuit 312 composed of the normally open AND gate **312*a* to the alarm device 314 by which the alarm is generated. If the external control member 316 is actuated a single time when the alarm is sounding, a switching signal is generated by the flip-flop 320 and applied through the inhibiting gate 330 to the flip-flop 332 of the switch control circuit means 324. The flip-flop 332 generates a snooze signal, which is applied through the OR gate 340 to the reset circuit 326 and the snooze control circuit 312 via the inverter 344. In this case, the AND gate 312*a* of the snooze control circuit 312 is inhibited to interrupt the supply of the alarm enabling signal to the alarm device for thereby temporarily stopping the sounding alarm. This snooze state is displayed by a display element 362 in response to the snooze signal. The AND gate 346 of the reset circuit 326 is opened in response to the snooze signal fed from the flip-flop 332, to pass the clock pulse $\phi$ to the time counter. The time counter generates an output signal as a reset signal when a predetermined time period has elapsed. The reset signal is applied through the OR gate 342 to the reset terminal of the flip-flop 332. Thus, the flip-flop 332 is reset and the output of the inverter 344 goes to a high level so that the AND gate 312*a* is opened to allow the alarm enabling signal to the alarm device 314, by which the alarm is generated. If, in this instance, the external control member 316 is actuated a predetermined number of times, i.e., four times within a given time period, the flip-flop 336 generates an alarm stopping signal which is applied through the OR gate 342 to the reset terminal of the coincidence memory circuit 310. Consequently, the coincidence memory circuit 310 is reset and the alarm enabling signal is not produced so that the alarm sounding is stopped. This alarm stop state is displayed by a display element 364 of the display device 328. If a predetermined time period has elapsed, the flip-flop 352 of the time counter generates an output signal which is applied through the OR gate 342 to the reset terminals of the flip-flops 332, 334 and 336, which are consequently reset and the reset condition of the coincidence memory circuit 310 is released. If it is desired to permanently reset the coincidence memory circuit 310, the external control member 318 is actuated so that the flip-flop 322 generates an alarm-set releasing signal which is applied through the OR gate 342 to the reset terminal of the memory circuit 310. This signal is applied through an inverter 370 to a display element 366 by which an alarm-set releasing state is displayed. The display device also has a display element 360** responsive to the time information signal a to provide a display of current time.

While the present invention has been shown and described with reference to the particular embodiments by way of example, it should be noted that other changes or modifications may be made without departing from the scope of the present invention. For example, although the electronic timepiece has been shown and described as of the type including a timekeeping circuit and an electro-optical display device, it should be born in mind that the principal concept of the present invention can be readily applied to an electronic timepiece of the type including a timekeeping means composed of a wheel train mechanism, and a display device driven by an electromechanical transducer actuated by the wheel train mechanism.

What is claimed is:

1. An electronic timepiece comprising:

a frequency standard providing a relatively high frequency signal;

a frequency divider providing a relatively low frequency signal in response to the relatively high frequency signal;

timekeeping means responsive to said relatively low frequency signal to provide a time information signal;

display means for providing a display of current time in response to said time information signal;

alarm memory means for storing alarm time;

coincidence detection means for detecting a coincidence between the alarm time and the current time to provide a coincidence signal in response thereto;

a coincidence memory circuit for storing said coincidence signal and producing an alarm enabling signal in response thereto;

a snooze control circuit normally operative to pass said alarm enabling signal therethrough;

means for generating an alarm in response to said alarm enabling signal; a single external control member serving as a snooze switch and an alarm stopping switch and adapted to generate first and second switching signals when said external control member is actuated in first and second predetermined actuation modes, respectively;

a snooze switching circuit responsive to said first switching signal to provide a snooze signal by which said snooze control circuit is inhibited to stop the operation of said alarm generating means;

a timer circuit responsive to said snooze signal and said relatively low frequency signal to provide an output when a predetermined time interval has passed after receiving said snooze signal;

said snooze switching circuit being responsive to said output to temporarily inhibit the supply of said snooze signal; and an alarm stop switching circuit responsive to said second switching signal to provide an alarm stop signal by which said coincidence memory circuit is rendered inoperative to stop the operation said alarm generating means.

2. An electronic timepiece as claimed in claim 1, in which said display means comprises a first display element to display said current time, a second display element to display a snooze state in response to said snooze signal, and a third display element to display an alarm stopping state in response to said alarm stopping signal.

3. An electronic timepiece as claimed in claim 1, in which said display means comprises a first display element to display said current time, a second display element to display a snooze state in response to said snooze signal, and a third display element to display an alarm stopping state in response to said alarm stopping signal.

4. An electronic timepiece comprising:

a frequency standard providing a relatively high frequency signal;

a frequency divider providing a relatively low frequency signal in response to the relatively high frequency signal;

timekeeping means responsive to said relatively low frequency signal to provide a time information signal;

display means for providing a display of current time in response to said time information signal;

alarm memory means for storing alarm time;

coincidence detection means for detecting a coincidence between the alarm time and the current time to provide a coincidence signal in response thereto;

a coincidence memory circuit including a flip-flop having a reset terminal for storing said coincidence signal and producing an alarm enabling signal in response thereto;

a snooze control circuit normally operative to pass said alarm enabling signal therethrough;

means for generating an alarm in response to said alarm enabling signal;

a single external control member serving as a snooze switch and an alarm stopping switch and adapted to generate first and second switching signals when said external control member is actuated in first and second predetermined numbers of actuations, respectively;

a snooze switching circuit responsive to said first switching signal to provide a snooze signal by which said snooze control circuit is inhibited to stop the operation of said alarm generating means;

a timer circuit responsive to said snooze signal and said relatively low frequency signal to provide an output when a predetermined time interval has passed after receiving said snooze signal;

said snooze switching circuit being responsive to said output to temporarily inhibit the supply of said snooze signal; and an alarm stop switching circuit responsive to said second switching signal to provide an alarm stop signal which is applied to the reset terminal of said coincidence memory circuit to reset said coincidence circuit to stop the operation of said alarm generating means.

5. An electronic timepiece as claimed in claim 4, in which said display means comprises a first display element to display said current time, a second display element to display a snooze state in response to said snooze signal, and a third display element to display an alarm stopping state in response to said alarm stopping signal.

6. An electronic timepiece comprising:

a frequency standard providing a relatively high frequency signal;

a frequency divider providing a relatively low frequency second switching signals when said external control member is actuated in first and second predetermined actuation modes, respectively;

a coincidence memory circuit including a flip-flop having a reset terminal and responsive to said coincidence signal to provide an alarm enabling signal;

a snooze control circuit coupled between said coincidence memory circuit and said alarm generating means for normally passing said alarm enabling signal to said alarm generating means, said snooze control circuit being responsive to said snooze signal for thereby interrupting the supply of said alarm enabling signal to said alarm generating means;

switching circuit means for generating a snooze signal and an alarm stopping signal in response to said first and second switching signals, respectively, to interrupt the supply of said coincidence signal to said alarm generating means for thereby temporarily stopping the alarm;

said switching circuit means comprising a snooze switching circuit responsive to said first switching signal to provide said snooze signal, and an alarm stop switching circuit responsive to said second switching signal to provide said alarm stop signal; and said alarm stop signal being applied to the reset terminal of said flip-flop to reset said coincidence memory circuit.

7. An electronic timepiece as claimed in claim 6, in which said display means comprises a first display element to display said current time, a second display element to display a snooze state in response to said snooze signal, and a third display element to display an alarm stopping state in response to said alarm stopping signal.

8. An electronic timepiece comprising:

a frequency standard providing a relatively high frequency signal;

a frequency divider providing a relatively low frequency signal in response to the relatively high frequency signal;

timekeeping means responsive to said relatively low frequency signal to provide a time information signal;

display means for providing a display of current time in response to said time information signal;

alarm memory means for storing alarm time;

coincidence detection means for detecting a coincidence between the alarm time and the current time to provide a coincidence signal in response thereto;

means for generating an alarm in response to said coincidence signal;

an external control member serving as a snooze switch and an alarm stopping switch and adapted to generate first and second switching signals when said external control member is actuated in first and second predetermined actuation modes, respectively;

a coincidence memory circuit responsive to said coincidence signal to provide an alarm enabling signal;

a snooze control circuit coupled between said coincidence memory circuit and said alarm generating means for normally passing said alarm enabling signal to said alarm generating means, said snooze control circuit being responsive to said snooze signal for thereby interrupting the supply of said alarm enabling signal to said alarm generating means;

switching circuit means for generating a snooze signal and an alarm stopping signal in response to said first and second switching signals, respectively, to interrupt the supply of said coincidence signal to said alarm generating means for thereby temporarily stopping the alarm;

said switching circuit means comprising a snooze switching circuit responsive to said first switching signal to provide said snooze signal, and an alarm stop switching circuit responsive to said second switching signal to provide said alarm stop signal; and a reset circuit including counter means for generating a reset signal when a predetermined time period has elapsed after said snooze signal and said alarm stopping signal have been generated, said snooze switching circuit and said alarm stop switching circuit being responsive to said reset signal to stop the supply of said snooze signal and said alarm stopping signal, respectively.

9. An electronic timepiece as claimed in claim 8, in which said external control member also serves as an alarm-set releasing switch when said external control member is actuated in a third predetermined actuation mode to provide a third switching signal, and in which said switching circuit means also comprises means for generating an alarm-set releasing signal in response to said third switching signal, said flip-flop of said coincidence memory circuit being reset in response to said alarm-set releasing signal so that said coincidence memory circuit is released from an alarm-set state.

10. An electronic timepiece comprising:

a frequency standard providing a relatively high frequency signal;

a frequency divider providing a relatively low frequency signal in response to the relatively high frequency signal;

timekeeping means responsive to said relatively low frequency signal to provide a time information signal;

display means for providing a display of current time in response to said time information signal;

alarm memory means for storing alarm time;

coincidence detection means for detecting a coincidence between the alarm time and the current time to provide a coincidence signal in response thereto;

a coincidence memory circuit responsive to said coincidence signal to provide an alarm enabling signal;

a snooze control circuit coupled between said coincidence memory circuit and said alarm generating means for normally passing said alarm enabling signal to said alarm generating means, said snooze control circuit being responsive to said snooze signal for thereby interrupting the supply of said alarm enabling signal to said alarm generating means;

means for generating an alarm in response to said alarm enabling signal;

a first external control member serving as a snooze switch and an alarm stopping switch and adapted to generate first and second switching signals when said external control member is actuated in first and second predetermined actuation modes, respectively;

a second external control member adapted to generate an input signal when actuated;

means for generating an alarm-set releasing signal in response to said input signal;

said coincidence memory circuit being released from its set state in response to said alarm-set releasing signal; and switching circuit means for generating a snooze signal and an alarm stopping signal in response to said first and second switching signals, respectively, to interrupt the supply of said coincidence signal to said alarm generating means for thereby temporarily stopping the alarm.

11. An electronic timepiece comprising:

a frequency standard providing a relatively high frequency signal;

a frequency divider providing a relatively low frequency signal in response to the relatively high frequency signal;

timekeeping means responsive to said relatively low frequency signal to provide a time information signal;

display means for providing a display of current time in response to said time information signal;

alarm memory means for storing alarm time;

coincidence detection means for detecting a coincidence between the alarm time and the current time to provide a coincidence signal in response thereto; a coincidence memory circuit including a flip-flop having a reset terminal and responsive to said coincidence signal to provide an alarm enabling signal;

a snooze control circuit coupled between said coincidence memory circuit and said alarm generating means for normally passing said alarm enabling signal to said alarm generating means, said snooze control circuit being responsive to said snooze signal for thereby interrupting the supply of said alarm enabling signal to said alarm generating means;

means for generating an alarm in response to said coincidence signal;

a first external control member serving as a snooze switch and an alarm stopping switch and adapted to generate first and second switching signals when said external control member is actuated in first and second predetermined actuation modes, respectively;

a second external control member adapted to generate an input signal when actuated;

means for generating an alarm-set releasing signal in response to said input signal;

said coincidence memory circuit being released from its set state in response to said alarm-set releasing signal; and switching circuit means for generating a snooze signal and an alarm stopping signal in response to said first and second switching signals, respectively, to interrupt the supply of said coincidence signal to said alarm generating means for thereby temporarily stopping the alarm.

* * * * *